US008784074B2

(12) United States Patent
Davey et al.

(10) Patent No.: US 8,784,074 B2
(45) Date of Patent: Jul. 22, 2014

(54) HIGH PRESSURE INTENSIFIERS

(75) Inventors: Peter John Davey, Somerset (GB); Vernon Lester Hutchings, Bristol (GB); Harry Richard Cove, British Columbia (CA)

(73) Assignee: Vetco Gray Controls Limited, Nailsea, Bristol (GB)

( * ) Notice: Subject to any disclaimer, the term of this patent is extended or adjusted under 35 U.S.C. 154(b) by 156 days.

(21) Appl. No.: 13/257,246

(22) PCT Filed: Feb. 10, 2010

(86) PCT No.: PCT/GB2010/050214

§ 371 (c)(1),
(2), (4) Date: Sep. 16, 2011

(87) PCT Pub. No.: WO2010/106350

PCT Pub. Date: Sep. 23, 2010

(65) Prior Publication Data

US 2012/0009072 A1 Jan. 12, 2012

(30) Foreign Application Priority Data

Mar. 19, 2009 (GB) ..... 0904660.8

(51) Int. Cl.
*F04B 49/22* (2006.01)

(52) U.S. Cl.
USPC ..... 417/295; 417/298

(58) Field of Classification Search
CPC ..... F04B 3/00; F04B 47/06
USPC ..... 417/225, 289, 295, 297, 298, 505
See application file for complete search history.

(56) References Cited

U.S. PATENT DOCUMENTS 4,924,671 A * 5/1990 Reinert ..... 60/428
2009/0032264 A1* 2/2009 Shepler ..... 166/370

FOREIGN PATENT DOCUMENTS

GB 1114259 A 5/1968
GB 2198081 A 6/1988
GB 2275969 A 9/1994

OTHER PUBLICATIONS

PCT Search Report and Written Opinion dated May 10, 2010 issued in connection with the PCT Application No. GB2010/050214 which was filed on Feb. 10, 2010.

* cited by examiner

*Primary Examiner* — Bryan Lettman
(74) *Attorney, Agent, or Firm* — Global Patent Operation

(57) ABSTRACT

A high pressure intensifier system is disclosed. The system has a high pressure intensifier configured to receive hydraulic fluid from an input and provide the fluid to an output at a higher pressure than at the input, a monitor configured to monitor the pressure of hydraulic fluid provided at the output, and a control configured to control the supply of hydraulic fluid from the input, and configured to maintain the pressure of hydraulic fluid provided at the output at substantially a predetermined value.

6 Claims, 1 Drawing Sheet

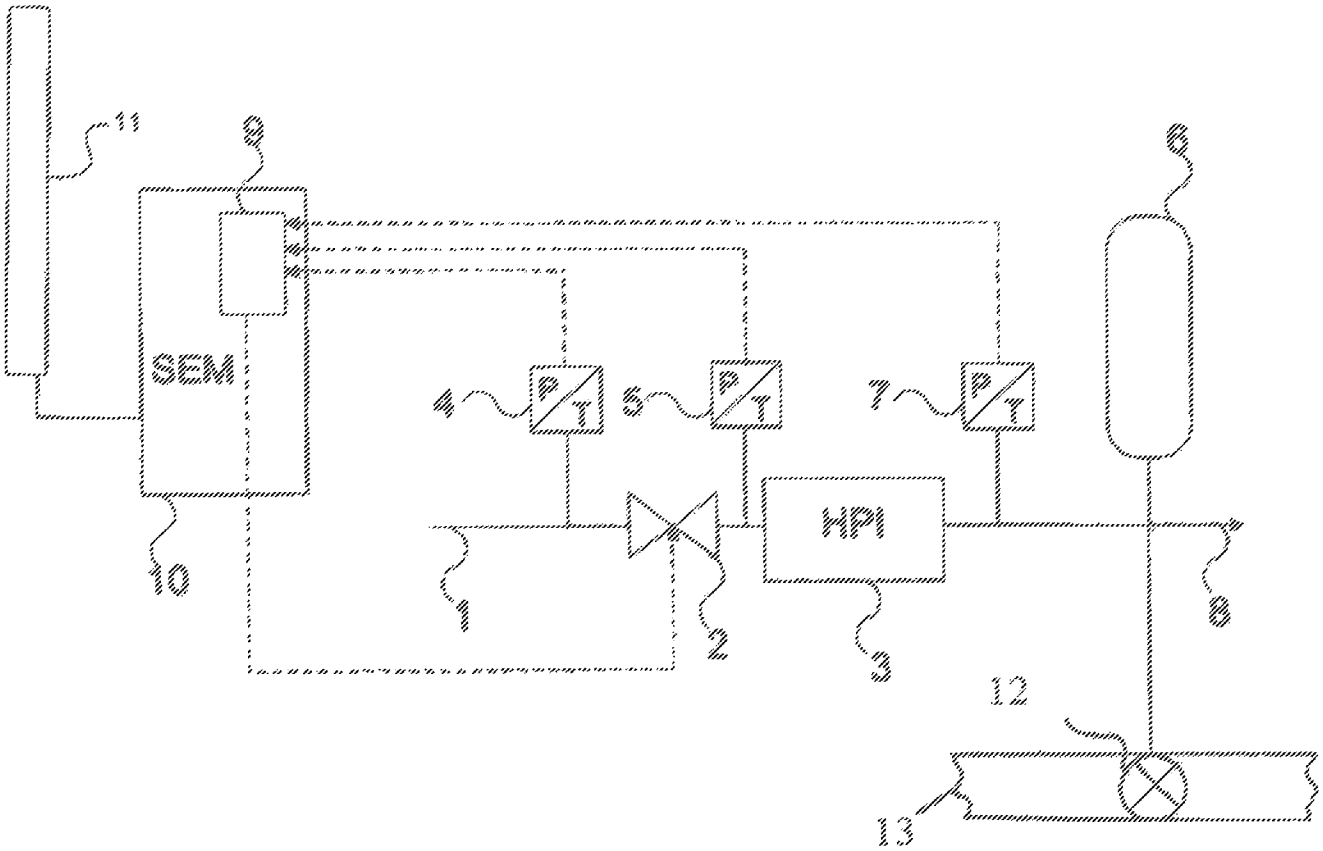
8
7
6
4
HPI
5
2
1
9
SEM
10
11
12
13

HIGH PRESSURE INTENSIFIERS

CROSS-REFERENCE TO RELATED APPLICATIONS

This is a national stage application under 35 U.S.C. §371 (c) of prior-filed, co-pending PCT patent application Ser. No. PCT/GB2010/050214, filed on Feb. 10, 2010 which claims priority to British patent application Ser. No. 0904660.8, filed on Mar. 19, 2009, each of which is hereby incorporated by reference in its entirety.

BACKGROUND OF THE INVENTION

1. Field of the Invention

The present disclosure relates to high pressure intensifiers.

2. Description of Related Art

High pressure intensifiers (HPIs) are employed in subsea well control systems to reduce the cost of the umbilical from the control center, which may be several hundred kilometers from the well head. Hydraulic control fluid is fed to the well control system via the umbilical at a pressure lower than that required by the control system. The lower pressure enables the umbilical walls to be thinner, making the umbilical smaller in diameter, lighter and easier to deploy, resulting in major cost reductions.

The HPI is located at the well end of the umbilical and increases the hydraulic pressure to a level required by the well hydraulic control system. An example of an HPI is described in GB-A-2 275 969.

Existing HPIs produce a fixed output pressure as a multiple of the input pressure, e.g. 5000 psi in and 10,000 psi out. This fixed pressure is not favoured by many well operators, because they are concerned, in particular, at the possibility of damage to the downhole safety valve (DHSV) fitted in the well fluid extraction flowline, and the major costs involved in its replacement in the event of damage. The DHSV is sensitive, in particular, to the difference in pressure between the production flowline pressure and the valve's hydraulic operating control pressure (a large difference causing the valve to slam hard when opening or closing) which is exacerbated by the fact that the production flowline pressure tends to fall over the life of the well. Well operators would consider this problem solved if the valve's hydraulic control pressure, typically derived from the output of the HPI, was adjustable, to suit changes in the production flowline pressure.

BRIEF SUMMARY OF THE INVENTION

According to embodiments of the present invention, there is provided a high pressure intensifier system comprising a high pressure intensifier configured to receive a hydraulic fluid from an input and provide the fluid to an output at a higher pressure than at the input; a monitor configured to monitor the pressure of hydraulic fluid provided at the output; and a control configured to control the supply of hydraulic fluid to the input, and configured to maintain the pressure of hydraulic fluid provided at the output at substantially a predetermined value.

BRIEF DESCRIPTION OF THE DRAWINGS

FIG. 1 is a schematic diagram of an embodiment of the invention.

DETAILED DESCRIPTION OF THE INVENTION

Referring to FIG. 1, a hydraulic fluid input 1, typically receiving the hydraulic fluid from an umbilical 11, feeds a directional control valve (DCV) 2 at the input to an HPI 3. Typically, monitoring means in the form of a pressure transducer 4 is fitted at the input to the DCV 2 and monitoring means in the form of a second pressure transducer 5 is fitted at the input to HPI 3. These transducers 4 and 5 are not essential for the functioning of the system but are fitted to provide confidence that the components of the system are operating correctly, bearing in mind that the equipment is on the seabed and not readily accessible and therefore monitoring for fault diagnosis is important to the well operator. The output of the HPI 3 feeds a hydraulic accumulator 6 and monitoring means in the form of a third pressure transducer 7 is fitted at the output 8 of the HPI 3, which output provides high pressure hydraulic fluid for the well control system, which normally includes a DHSV 12 adjacent a well fluid extraction flow line 13. The outputs of the three pressure transducers 4, 5 and 7 are fed to an HPI electronic control unit 9, which is conveniently located in the existing well control system subsea electronic module (SEM) 10, since the SEM already communicates electronically with the control center via the umbilical 11 for well control. The output of the HPI electronic control unit 9 controls the DCV 2.

The mode of operation is that hydraulic fluid is fed to the DCV input 1, which commences in the open position, allowing fluid flow to the HPI 3, which then pumps fluid to the hydraulic accumulator 6 with other feeds to the well control hydraulic devices being closed. The rising pressure at the HPI output 8 is monitored by the pressure transducer 7, which feeds pressure information to the electronic control unit 9 in the SEM 10. If the pressure at the HPI output 8 is lower than that required by the well control hydraulic system, and in particular the DHSV 12, the output of the electronic control unit 9, keeps the DCV 2 open. If the pressure sensed by the pressure transducer 7 reaches a pre-set threshold set in the electronic control unit 9, its output changes to close the DCV 2. If the pressure, sensed by the pressure sensor 7, at the HPI output 8 falls, as a result of the operation of well control hydraulic devices, the electronic control unit 9 opens the DCV 2 until the required pressure at output 8 is restored to a predetermined value. Thus, the pressure at the HPI output 8 is maintained automatically and is varied as required by alteration of the pre-set pressure threshold stored in the electronic control unit 9. Typically, this pressure threshold is changed by communicated messages, through the existing communication link from the SEM to the well control center, via the umbilical 11. Thus the well operator can adjust the HPI output pressure from the control center, typically a surface control platform.

The DCV employed is monostable in that it remains open when electrically energised and closed when the electrical supply is removed.

Embodiments of the present invention are not restricted to the use of a single HPI and its control means as systems using more than one HPI are possible to produce a plurality of intermediate pressures as desired.

The pressure of the high pressure hydraulic supply from the HPI can be varied as required, a facility not available from existing HPI systems. In particular, the output pressure from the HPI can be reduced as the well ages and the production flowline pressure falls, thus maintaining the pressure differential between the hydraulic control pressure operating a DHSV and the flowline pressure, and thereby optimising the life of the DHSV.

The invention claimed is:

1. A high pressure intensifier system comprising:

a high pressure intensifier configured to receive hydraulic fluid from an input and provide the fluid to an output at a higher pressure than at the input;

a monitor configured to monitor the pressure of hydraulic fluid provided at the output; and a control configured to control the supply of hydraulic fluid to the input, and configured to maintain the pressure of hydraulic fluid provided at the output at substantially a predetermined value, wherein the control comprises an electronic control coupled with the monitor, and configured to compare the pressure of hydraulic fluid provided at the output with a predetermined value, the electronic control is provided in a subsea electronic module for a subsea well control system, and the electronic control is in communication with a control center via an umbilical;

wherein the output is used to operate a downhole safety valve in a well fluid extraction flowline; and wherein the predetermined value may be changed by communicated messages from the control center via the umbilical to limit a pressure differential between the output and fluid in the flowline.

2. A system according to claim 1, wherein the control comprises a valve through which the hydraulic fluid is supplied from the input, and wherein the control is configured to open and close the valve in dependence on the pressure of hydraulic fluid at the output as monitored by the monitor.

3. A system according to claim 1, wherein the control comprises:

a valve through which the hydraulic fluid is supplied from the input; and an electronic control coupled with the monitor and configured to compare the pressure of hydraulic fluid provided at the output with a predetermined value, the electronic control configured to control the opening and closing of the valve in dependence on the result of the comparison.

4. A system according to claim 3, wherein the monitor is coupled with the electronic control and configured to monitor the pressure of hydraulic fluid supplied by the valve.

5. A system according to claim 1, wherein the monitor coupled with the electronic control and configured to monitor the pressure of hydraulic fluid at the input.

6. A system according to claim 1, wherein the control is configured to adjust the predetermined value.

* * * * *